US005147001A

United States Patent [19]

Chow et al.

[11] Patent Number: 5,147,001

[45] Date of Patent: Sep. 15, 1992

[54] DRILL BIT CUTTING ARRAY HAVING DISCONTINUITIES THEREIN

[75] Inventors: Jacob Chow, Salt Lake City; Ralph M. Horton, Murray; Mark L. Jones, Midvale, all of Utah

[73] Assignee: Norton Company, Worcester, Mass.

[21] Appl. No.: 707,411

[22] Filed: May 28, 1991

Related U.S. Application Data

[63] Continuation of Ser. No. 490,041, Mar. 6, 1990, abandoned.

[51] Int. Cl.[5] ..... E21B 10/56

[52] U.S. Cl. ..... 175/428; 175/430; 175/434

[58] Field of Search ..... 175/329, 410; 76/108.2, 76/108.4

[56] References Cited

U.S. PATENT DOCUMENTS

| | | | |
|---|---|---|---|
| 4,128,136 | 12/1978 | Generoux | 175/410 X |
| 4,512,426 | 4/1985 | Bidegaray | 175/329 |
| 4,913,247 | 4/1990 | Jones | 175/410 X |
| 4,943,488 | 7/1990 | Sung et al. | 428/552 |

*Primary Examiner*—William P. Neuder
*Attorney, Agent, or Firm*—Trask, Britt & Rossa

[57] ABSTRACT

The present invention comprises a cutting structure for earth boring drill bits and a bit including at least one such structure comprising a substantially planar array of cutting elements arranged in substantially contiguous mutual proximity, the array incorporating at least one discontinuity therein dividing it into a plurality of sub-arrays.

15 Claims, 2 Drawing Sheets

DRILL BIT CUTTING ARRAY HAVING DISCONTINUITIES THEREIN

This application is a continuation of application Ser. No. 490,041, filed Mar. 6, 1990, now abandoned.

BACKGROUND OF THE INVENTION

The present invention relates generally to drill bits, and more specifically relates to drill bits for earth boring, which includes cutters comprising an array of discrete cutting elements.

It is known in the art that certain earth formations are more susceptible to being bored with bits having large cutters thereon, usually so-called "plastic" or "gumbo" formations, where small cutters get mud-bound with drilling mud and the bit consequently "balls up", slowing or stopping forward progress of the well bore. Large unitary cutters, large being referred to herein as those of ¾" diameter and above, are generally more expensive than their smaller counterparts, and present problems of their own when mounted on a bit face. Specifically, when polycrystalline diamond compact ("PDC") cutters are brazed or otherwise metallurgically bonded to a support or carrier surface on a bit face, the differing coefficients of thermal expansion between the PDC substrate material and that of the support or carrier subject the PDC to a large, permanent residual stress when the braze cools, thus rendering the PDC more susceptible to fracture upon impact with the formation and/or fracture at the braze or metallurgical bond line. Moreover, as alluded to above, PDC's must be bonded to the bit body or to a carrier, which itself is secured on the bit face after the furnacing of a matrix-type bit, which usually comprises a matrix of tungsten carbide powder bonded together by a copper-based binder alloy. The method of producing such a bit is well known in the art, and comprises manufacturing a mold or "boat" of graphite, ceramic or other material which possesses on its interior the characteristics of the bit face to be produced, these characteristics being milled or otherwise cut or molded therein; filling the mold with a tungsten carbide or other suitable powder, placing beads of a binder alloy in the mold as well as flux; and furnacing the bit at a temperature high enough to infiltrate the powder with the melted binder alloy.

If, as noted above, one wishes to use PDC cutters on the bit, it is necessary to bond them to the bit face after furnacing, as the furnacing temperature, generally in excess of 1070° C., will thermally degrade PDC's into a fragile, brittle and/or relatively soft state, making them useless as cutters. It is known to furnace natural diamonds directly into a bit body, as natural diamonds have a thermal stability suitable for such an operation. Similarly, there exist on the market so-called "thermally stable" polycrystalline diamond compact products ("TSP's") which can survive furnacing without significant degradation. Two types of TSP's are on the market today, leached products, where most of the non-diamond material in the compact has been removed, and unleached products, where the non-diamond material in the compact possesses similar thermal expansion characteristics to the diamond and does not degrade the diamond at temperatures up to 1200° C. In either case, these TSP's may be furnaced into the bit, providing a cutter-laden bit in a single operation. Affixation of the TSP cutters to the bit face may be enhanced by coating them with metal as is known in the art, to provide a chemical (metallurgical) bond between the bit matrix and cutter. One exemplary apparatus and method for coating TSP elements is described in U.S. Pat. No. 4,943,488, issued on Jul. 24, 1990 and assigned to the designee of this application. The specification of U.S. Pat. No. 4,943,488 is incorporated herein by this reference.

In some soft, plastic formations, there are stringers of harder, more abrasive rock, or a bit may have to drill through both soft and hard, abrasive rock in close succession without being pulled from the well bore. Bits having several types of cutting elements for cutting different types of formations are known; see for example, U.S. Pat. No. 4,512,426 to Bidegaray, assigned to Eastman Christensen Company. Using TSP elements in conjunction with PDC's is known. One such bit design uses PDC cutters in combination with cutters comprising mosaic-like arrays of small, triangular-faced polyhedral TSP's, each array simulating a larger unitary cutter. Such bits are sold by the Eastman Christensen Company of Salt Lake City, Utah, U.S.A., as the Mosaic TM series of bits. The type of cutter utilized on the aforesaid bits is described in U.S. Pat. No. 4,726,718, assigned to Eastman Christensen Company and the bonding of the TSP's into an array may be enhanced by the coating process of the above-referenced U.S. Pat. No. 4,943,488.

Planar TSP cutters up to at least 1.5 inches in diameter are available from DeBeers under the trade-name "Syndax 3." Such cutters are not readily bonded during infiltration to matrix-type bits and substantial residual stresses will result upon cooling the bit due to the difference in thermal expansion of the TSP and the bit matrix. Moreover, large single pieces provide less geometric flexibility.

It has been proposed to fabricate very large TSP array cutters, and even entire cutter blades extending from the gage of the bit to the center of the bit face. See, for example, U.S. Pat. No. 4,913,247, issued on Apr. 3, 1990, in the name of Mark L. Jones, and assigned to Eastman Christensen Company. Such TSP-array cutter bits would not only provide a large cutting surface for plastic formations, but be abrasion-resistant so as to better survive stringers, in addition to being furnaceable into the bit.

Clearly, it is desirable to produce a bit having large cutting surfaces at reasonable cost and without the aforementioned thermal stress problems. Merely enlarging the array of small TSP elements, such as is suggested in the Jones application, was believed to be a solution, the theory being that a plurality of small TSP elements would economically form a large, predominantly-diamond cutting surface without being detrimentally affected by the thermal stress associated with a large, unitary cutter. However, it has been discovered that this thermal stress problem pervades even a TSP array, in that bits, incorporating large TSP arrays, have encountered delamination of the entire layer of TSP elements, both before and during drilling, due to the stress between the TSP elements and the bit matrix. The coating method of the above-referenced Sung and Chen application, while enhancing the diamond to matrix bond, actually aggravates the stress problem due to the strength of the diamond to matrix bond. In fact, instances of diamond fracture instead of bond fracture have been experienced under stress.

Stress between the TSP elements and the bit matrix is believed to occur during cooling of the bit after furnacing as a result of the different thermal expansion rates of the TSP and the matrix. Stress cracks are generally parallel to the TSP/matrix interface, and may later intersect with cracks in the cutter surface caused by impact stresses experienced during drilling, thereby resulting in premature cutter loss from the bit.

Accordingly, there is a need for a cutter configuration which can provide large cutting surfaces without the self-destructive tendencies of the large cutters and cutter arrays of the prior art.

SUMMARY OF THE INVENTION

In contrast to the prior art, the present invention affords a simple but elegant means and method of providing a large cutter of any configuration without a destructive level of thermally-induced stress. The cutter of the present invention comprises a substantially planar array of small TSP elements bonded into a bit face matrix. The matrix behind the array may be reinforced against impact, such as by a steel blade, pins or other means, and the TSP elements may be coated for bond-enhancement with the matrix. The TSP element array is interrupted at intervals by discontinuities where no TSP elements are located, thereby forming sub-arrays. Preferably, the discontinuities are linear, and most preferably, occur at intervals of no more than substantially one inch (1"). The discontinuities may extend from the bit face to the edge of the array in contact with the formation, and in bits with very deep cutting arrays, such as bladed bits, the discontinuities may run in several directions to intersect and thereby further segregate sub-arrays. Moreover, the discontinuities may comprise matrix material or be formed by offsetting portions of the array from other portions.

The discontinuous cutting element arrays of the present invention provide lower residual stress in each sub-array than in a large cutter without such discontinuities, and the discontinuities also provide a barrier to crack propagation across an entire array, so that a crack or failure in a particular sub-array will not cause catastrophic failure of the entire array, but will be locally contained.

BRIEF DESCRIPTION OF THE DRAWINGS

The present invention will be more readily appreciated by one of ordinary skill in the art through a reading of the following detailed description of the preferred embodiments, taken in conjunction with the accompanying drawings, wherein.

DESCRIPTION OF THE PREFERRED EMBODIMENTS OF THE INVENTION

Figure 1:
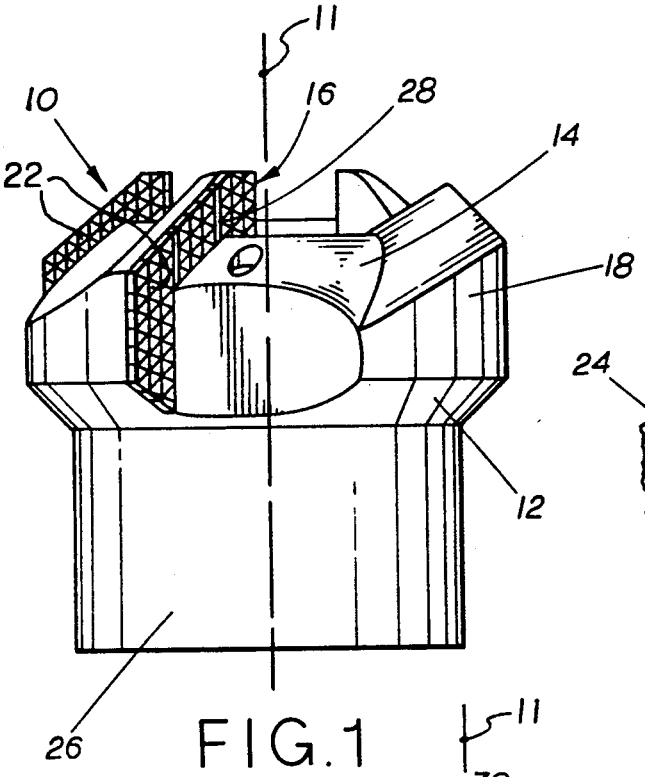
FIG. 1 is a perspective view of a core bit utilizing cutting arrays according to a first preferred embodiment of the present invention.
Figure 3:
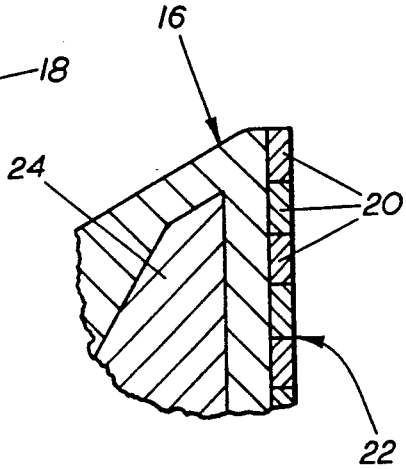
FIG. 3 is a partial side sectional elevation of the array of FIG. 2.
Figure 2:
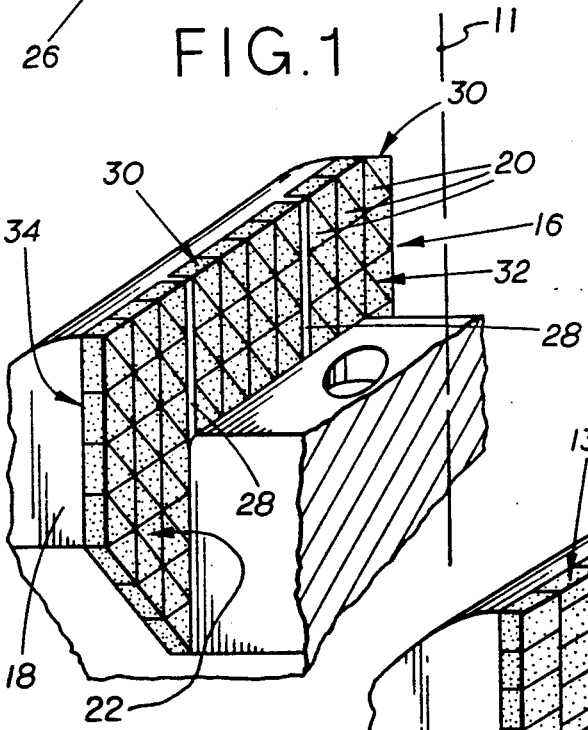
FIG. 2 is an enlarged perspective view of a single cutting array from the bit of FIG. 1.

Referring to FIGS. 1, 2 and 3, core bit 10 includes a body section 12 having mounted on its face 14 cutting arrays, indicated generally at 16, and gage pads, indicated generally at 18. Cutting arrays 16 are each "blades" in configuration, facing generally in the direction of bit rotation and comprising a plurality of TSP elements 20, and engage the earth formation as the bit 10 rotates about its longitudinal axis 11 in penetration of the earth. Gage pads 18 may serve a cutting function, but normally would not unless extending radially beyond those portions of cutter blades 16 which extend to the gage of core bit 10.

Body 12 of bit 10 is preferably, at least in part, a molded component fabricated through conventional metal infiltration technology, wherein body 12 comprises a tungsten carbide matrix infiltrated with a copper-based binder alloy when the bit mold is placed in a furnace and heated to a temperature sufficient to melt the binder but not the tungsten carbide, and below the thermal degradation temperature of the cutting elements 20, which are preferably TSP's.

In formation of the core bit 10 or a drill bit with integral cutting arrays 16, the bit mold or "boat" is carved, milled, or otherwise configured on its interior with the exterior configuration of bit 10, including blades 16. The TSP elements 20 are then disposed in their intended positions on the blades, and adhesively maintained there to secure them in place until furnacing. Alternatively, the TSP's may be affixed to a mesh, screen or other support to maintain positioning and spacing, and the mesh, screen or other support or the cutting elements thereon, secured to the mold area defining the front or cutting substantially planar face 22 of the cutting array. Tungsten carbide powder is then placed in the mold, and vibrated to uniformly compact it. Binder alloy is then placed in the mold over the tungsten carbide, and flux above the binder. Prior to placing the tungsten carbide powder in the mold, a tubular bit blank 24 is suspended above the mold and partially extended into the interior thereof. After loading the tungsten carbide powder and binder, the mold is then placed in a furnace, and the binder alloy melted to infiltrate the bit body tungsten carbide matrix. Upon solidifying, the binder consolidates the matrix powder and bonds the blank thereto. This bit blank is subsequently interiorly threaded on the end extending out of the bit body to form a bit shank 26, or may be welded to such a threaded shank for connection to a coring tool. If a drill bit is being made, the bit blank is exteriorly threaded or may be welded to a threaded shank for connection to a drill string or to the drive shaft of a downhole motor.

After the bit body 12 is furnaced and cooled, the cutting elements 20 have been metallurgically secured into cutting arrays 16 by the previously described means known in the art. As in prior art bits, however, there is residual thermal stress between the cutting elements 20 and the matrix supporting the arrays 16. The present invention comprises the incorporation of discontinuities 28 in the cutting arrays 16, whereby residual thermal stresses are minimized and localized.

In the embodiments of FIGS. 1–3, discontinuities 28 comprise linear discontinuities of matrix material dividing cutting arrays 16 into sub-arrays 30. Discontinuities 28 are oriented substantially parallel to the longitudinal axis 11 of the bit 10 and to the direction of travel of the bit 10 when it is in operation. In order to engage or sweep the formation being cut by the arrays 16 from the inner gage 32 of the arrays to the outer gage 34, the discontinuities of each blade may be radially offset from those on the other blades so that there is no rotational path swept only by matrix material, which would obviously be detrimental to cutting action and destructive to the arrays 16.

Figure 4:
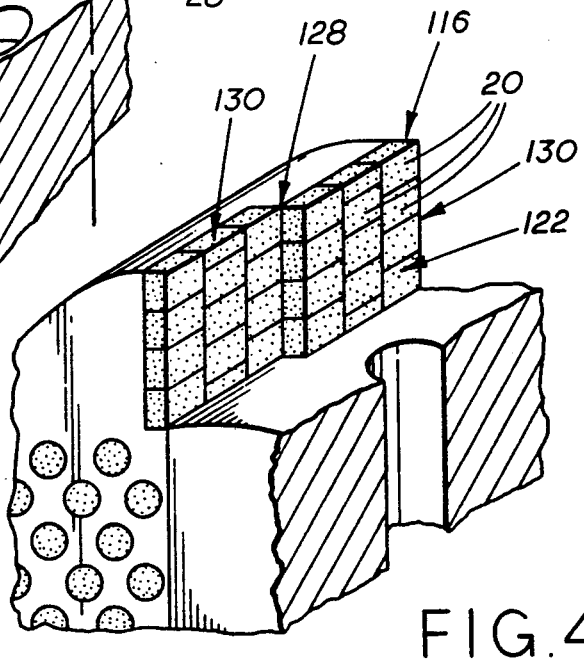
FIG. 4 is an enlarged perspective view of a single cutting array according to a second preferred embodiment of the present invention, utilized on a drill bit.

If it is desired to form an array 16 with discontinuities but without gaps in the diamond cutting face presented to the formation as the bit rotates, a cutting array 116, shown in FIG. 4 of the drawings, may be employed. In array 116, cutting elements 20 are again grouped in sub-arrays 130, but the discontinuities 128 in the array 116 are achieved by offsetting the sub-arrays 130 in the direction of rotation of the bit 10. The embodiment of FIG. 4 thus interrupts residual thermal stress extending across the cutting face 122 of the array 116 by placing thermal stresses of each sub-array in different, offset planes rather than by interrupting a single planar array of cutting elements.

While the bit of FIGS. 1–3 utilizes triangular cutting elements 20, and that of FIG. 4 employs square or rectangular cutting elements 20, the shape and/or size of the elements 20 is not critical to and does not limit the invention. For example, in FIG. 5 of the drawings, cutting elements 20 in array 216 are of both shapes, and discontinuities 228 are oriented at an angle to the direction of bit travel. Further, as the array 216 is deeper or higher than that of the previously discussed embodiments, discontinuities 228 are placed at two different angles so as to intersect and further subdivide array 216 into sub-arrays 230. While discontinuities 228 are shown in FIG. 5 to intersect at a substantially right angle, the invention is not so limited, and other intersection angles have equal utility.

Figure 6:
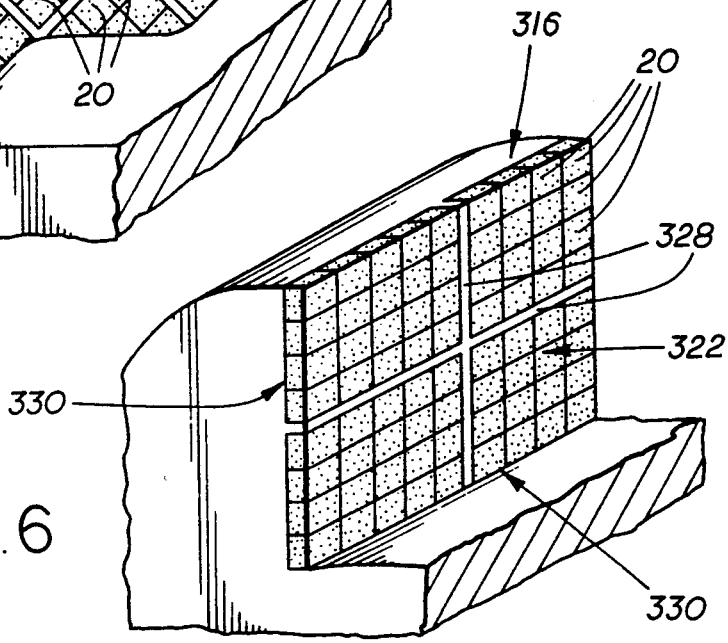
FIG. 6 is an enlarged perspective view of a fourth preferred embodiment of the present invention.

As shown in FIG. 6 of the drawings, intersecting discontinuities 328 may be utilized in an array 316 so that the array is divided horizontally and vertically instead of at oblique angles as in array 216. In such an instance, it would be desirable, as noted previously with respect to the embodiment of FIGS. 1–3, to radially offset the vertical discontinuities to achieve full cutting element coverage of the face of the bit, and additionally to vertically offset the horizontal discontinuities to avoid destruction of the cutting arrays on the bit by presenting only matrix material to the formation as the arrays wear and the horizontal discontinuities are reached.

Figure 5:
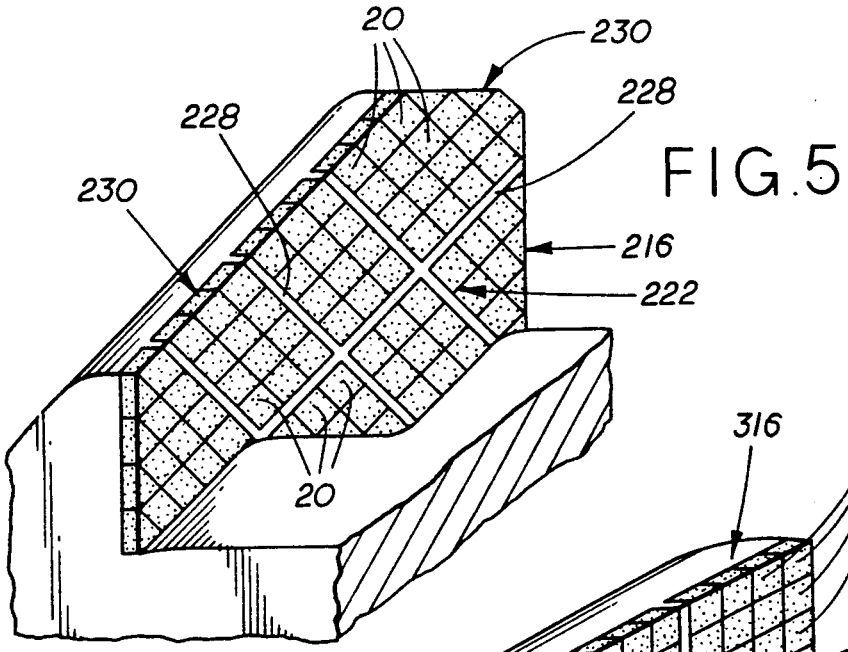
FIG. 5 is an enlarged perspective view of a third preferred embodiment of the present invention.

In both FIGS. 5 and 6 the discontinuities are shown as interruptions in the array of cutting elements 20 which are filled with matrix material. However, the sub-array-offset type discontinuities depicted in FIG. 4 may be utilized in lieu of, or even in addition to, the sub-array-interruption type of discontinuity.

While it has not been established that a particular discontinuity spacing is optimum, such being in large part dependent upon the composition of the bit matrix and of the cutting elements as well as the nature of the bond therebetween, it is believed that the discontinuities should be placed at no more than substantially one inch intervals in any one direction on the cutting face of the array to prevent accumulation of large residual thermally-induced stresses which could augment impact stresses encountered during drilling to promote bit failure. In the unlikely event that the accumulated residual stresses are sufficient to cause delamination of elements 20 from the array under impact, the existence of the discontinuities will preclude the delamination and failure of the sub-array from spreading to adjacent sub-arrays.

Figure 7:
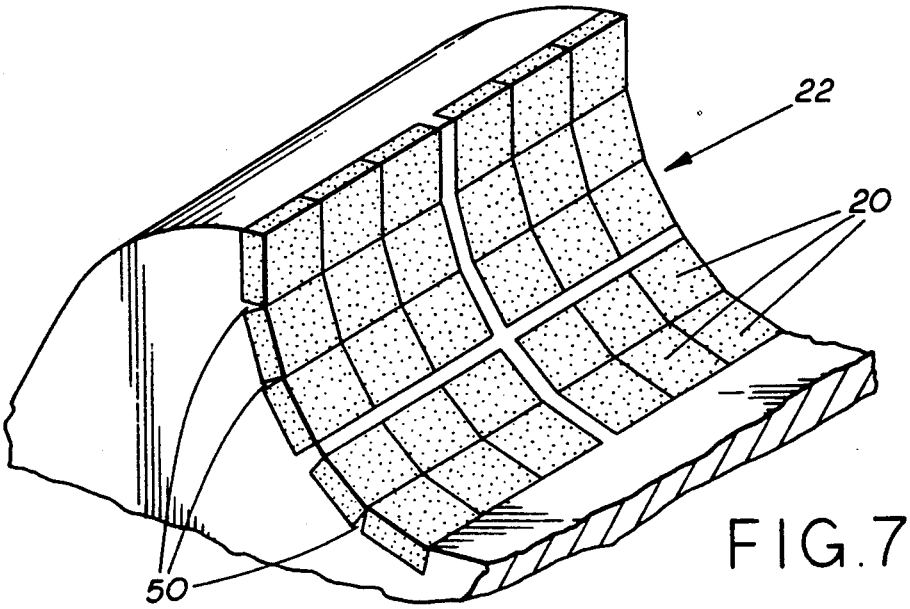

The previously-disclosed embodiments of the invention have been described and depicted in terms of perfectly planar cutting arrays, but it should be understood and appreciated that the term "planar" encompasses not only both an array on a single plane and adjacent but offset perfectly planar arrays, but also arrays, such as is depicted in FIG. 7 of the drawings, wherein cutting elements 20 define an arcuate cutting surface 22. The advantage of such an arcuate surface is to provide additional bonding capability between the bit matrix and the elements 20 by allowing the matrix material as at 50 to extend between adjacent elements 20. This provides not only more opportunity for a strong metallurgical bond if the elements are metal coated as is known in the art, but also lends mechanical support.

While the drill bit and cutting array of the present invention has been described in terms of Preferred embodiments, it will be understood that it is not so limited. Those of ordinary skill in the art will appreciate that many additions, deletions and modifications to the preferred embodiments may be made without departing from the spirit and scope of the claimed invention. For example, the cutting array of the present invention may be employed with a steel body bit, the array being preformed by hot pressing or infiltration techniques known in the art. The preform is then Post-brazed or otherwise secured to the bit after the array is furnaced. Alternatively, the cutting array might be formed on or bonded to a support including one or more studs which are inserted in apertures on the face of the bit, which technique also facilitates replacement of worn or damaged cutting arrays, or tailoring cutting element compositions to particular formations.

We claim:

1. A drill bit for drilling a subterranean formation, including at least one substantially planar cutting face disposed at an acute angle to the longitudinal axis of said drill bit, facing generally in the direction of the bit rotation and comprised of a plurality of discrete cutting elements, said substantially planar cutting face incorporating at least one discontinuity therein substantially dividing said substantially planar cutting face into a plurality of laterally adjacent segments, each of said laterally adjacent segments including a plurality of said discrete cutting elements in substantially contiguous mutual lateral proximity.

2. The drill bit of claim 1, wherein said at least one discontinuity is substantially linear.

3. The drill bit of claim 2, wherein said at least one discontinuity comprises a plurality of substantially linear, intersecting discontinuities.

4. The drill bit of claim 2, wherein said at least one discontinuity is aligned substantially parallel to the longitudinal axis of said drill bit.

5. The drill bit of claim 2, further including at least a second substantially linear discontinuity oriented substantially perpendicularly to said at least one substantially linear discontinuity.

6. The drill bit of claim 1, wherein said at least one discontinuity comprises a plurality of substantially linear discontinuities oriented at acute angles to the longitudinal axis of said drill bit.

7. The drill bit of claim 6, wherein at least two of said plurality of discontinuities intersect.

8. The drill bit of claim 1, wherein said cutting face is secured in a volume of matrix material supporting structure, and said at least one discontinuity comprises matrix material extending between and dividing said cutting face into said plurality of segments.

9. The drill bit of claim 1, wherein said at least one discontinuity is defined by the offset of said segments from one another in the direction of rotation of said drill bit.

10. The drill bit of claim 9, wherein said at least one discontinuity is substantially linear.

11. The drill bit of claim 9, further including at least a second substantially linear discontinuity intersecting said first discontinuity.

12. The drill bit of claim 9, wherein said at least one discontinuity is aligned substantially parallel to the longitudinal axis of said drill bit.

13. The drill bit of claim 12, further including at least a second substantially linear discontinuity oriented substantially perpendicularly to said at least one substantially linear discontinuity.

14. The drill bit of claim 9, wherein said at least one discontinuity comprises a plurality of substantially linear discontinuities oriented at acute angles to the longitudinal axis of said drill bit, at least one of said discontinuities being defined by the offset of at least two segments from one another in the direction of rotation of said drill bit.

15. The drill bit of claim 14, wherein at least two of said plurality of discontinuities intersect.

* * * * *